US007857740B2

(12) United States Patent
Suaste

(10) Patent No.: US 7,857,740 B2
(45) Date of Patent: Dec. 28, 2010

(54) BENCH PLATFORM WITH MULTIPLE FUNCTIONS

(75) Inventor: Hector Alejandro Suaste, North Vancouver (CA)

(73) Assignee: Vencompass Group Enterprises (CA)

( * ) Notice: Subject to any disclaimer, the term of this patent is extended or adjusted under 35 U.S.C. 154(b) by 699 days.

(21) Appl. No.: 11/164,801

(22) Filed: Dec. 6, 2005

(65) Prior Publication Data

US 2007/0129227 A1 Jun. 7, 2007

(51) Int. Cl.
*A63B 26/00* (2006.01)

(52) U.S. Cl. ..... 482/142; 482/34; 482/79; 482/146

(58) Field of Classification Search ..... 482/31, 482/146–147, 79–80, 34, 148, 139, 51, 907, 482/23, 91, 121–126, 129–130, 140, 142
See application file for complete search history.

(56) References Cited

U.S. PATENT DOCUMENTS 3,488,049 A * 1/1970 Sasser, Jr. ..... 482/146
5,203,279 A * 4/1993 Eversdyk ..... 119/712
5,358,463 A * 10/1994 Fuentes ..... 482/141
5,795,277 A * 8/1998 Bruntmyer ..... 482/146
5,897,474 A 4/1999 Romero
6,017,297 A * 1/2000 Collins ..... 482/146
6,461,285 B1 * 10/2002 Theunissen et al. ..... 482/146
6,705,977 B1 * 3/2004 Ziak ..... 482/146
6,872,175 B2 * 3/2005 Lin ..... 482/146
6,945,920 B1 * 9/2005 Kemery et al. ..... 482/146

FOREIGN PATENT DOCUMENTS

| | | |
|---|---|---|
| CA | 1264168 | 1/1990 |
| CA | 2206028 | 12/1998 |
| CA | 2443033 | 3/2003 |
| WO | 9855184 | 12/1998 |

* cited by examiner

*Primary Examiner*—Lori Baker
(74) *Attorney, Agent, or Firm*—Vermette & Co.; Clifford W. Vermette; Denis R. O'Brien

(57) ABSTRACT

A bench platform assembly, which has a rectangular deck having a plurality of spaced apart holes therein for permitting the free passage therethrough of an elastic cord or tubing or rope; and a semicircular rocker assembly affixed to a central bottom portion of said deck. Two removable rectangular blocks allow the bench platform to become a fixed platform.

15 Claims, 4 Drawing Sheets

BENCH PLATFORM WITH MULTIPLE FUNCTIONS

FIELD

The present invention relates to a bench platform capable of multiple uses for a wide variety of exercises.

BACKGROUND

There are various types of fitness exercises that address different aspects of fitness such as aerobics, stability, mobility, muscle strength, muscle endurance, core training, pilates, yoga and plyometrics ranging from rehabilitation to extreme for all sports. Generally, the performance of such exercises require several different items of equipment such as stepping platforms, bench platforms, blocks, elastic cord, etc. Bench platforms are generally of two types, namely, rocker boards and wobble boards. A rocker board permits only side-to-side rocking movement while a wobble board permits side-to-side and front to back movement, over a 360-degree range. Both boards enhance range of movement and stability, and develop better core stability and strength. A tool commonly used by fitness classes is the stepping platform. It is used in step aerobics to intensify the workout and consume more oxygen. A block is another tool used in yoga to aid in stretching. It can be used to support the user when in the basic sitting position with legs crossed. Elastic cord or bands and rope can be used for resistive exercises to give a resistance, which increases with extension. It would be advantageous to be able to combine a number of items of exercise equipment into a single portable item.

SUMMARY OF THE INVENTION

According to the invention there is provided a bench platform, which has a rectangular deck having a plurality of spaced apart holes therein for permitting the free passage therethrough of an elastic cord or tubing or rope; and a semi-circular rocker assembly affixed to a central bottom portion of said deck. By being able to use elastic cord or tubing or rope together with the bench platform, it is possible to expand considerably the range of exercises to include negative and positive resistance exercises.

There may be cross supports on either end of said rocker assembly forming a square recessed area on a bottom central portion of said deck dimensioned to receive a soccer or medicine ball. The square recessed area constrains rolling of the ball relative to the deck and requires rotation of the bench platform in order to rotate the ball.

Preferably, a pair of blocks each removably attachable to a bottom surface of the deck at either end thereof support the deck at a height from a flat support, the same as the height of the rocker assembly.

The blocks may have rectangular sides.

Elongated strips of a high friction material may be attached to a top surface of the deck.

The deck is, preferably, 38 inches long and 10.5 inches wide.

The height of the rocker assembly plus the thickness of deck may total 6 inches.

A pair of spaced apart ribs may extend longitudinally out from the rocker assembly on each end thereof and adjacent each longitudinally extending edge of the deck.

The rocker assembly may advantageously include two spaced apart semi-circular plates mounted on a bottom center region of the deck adjacent each edge thereof.

BRIEF DESCRIPTION OF THE DRAWINGS

Further features and advantages will be apparent from the following detailed description, given by way of example, of a preferred embodiment taken in conjunction with the accompanying drawings, wherein.

DETAILED DESCRIPTION WITH REFERENCE TO THE DRAWINGS

Figure 1:
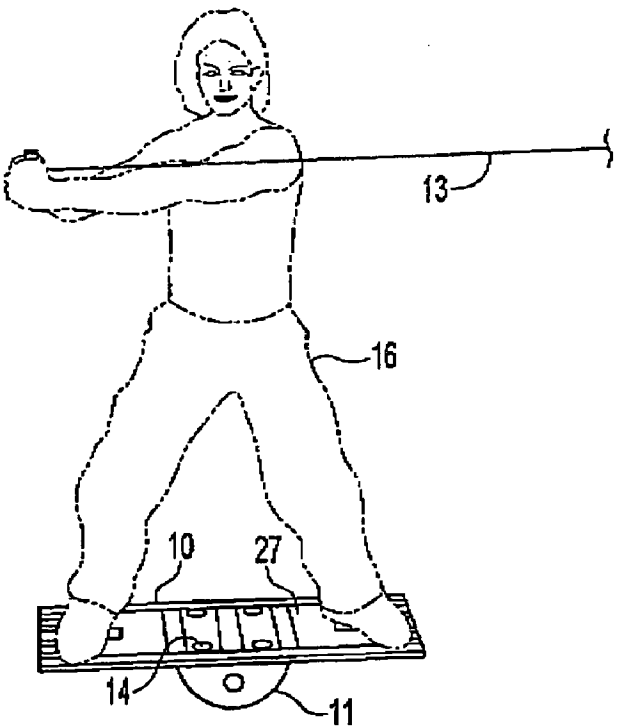
FIG. 1 is a perspective view of the bench platform with a user and an externally attached elastic cord or tubing or rope.

Referring to FIG. 1 the bench platform 10 has a deck 27 supported in the center by a rocker 11. The deck may be substantially rectangular and the rocker is aligned substantially longitudinally with the deck. A plurality of holes 14 permit passage through the deck of elastic cord or tubing or rope 13 for use by a user 16 in a variety of exercises. The rocker 11 has a semicircular outer surface, which allows a user to practice balancing against the side-to-side rocking motion permitted by the rocker 11. Ribs 22 (see FIGS. 2 and 10) extend from rocker 11 laterally to provide rigidity to the bench platform 10. Similarly, cross supports 20 extend from a front face 17 to a back face 15 of the bench platform 10 on either side of rocker 11.

Figure 2:
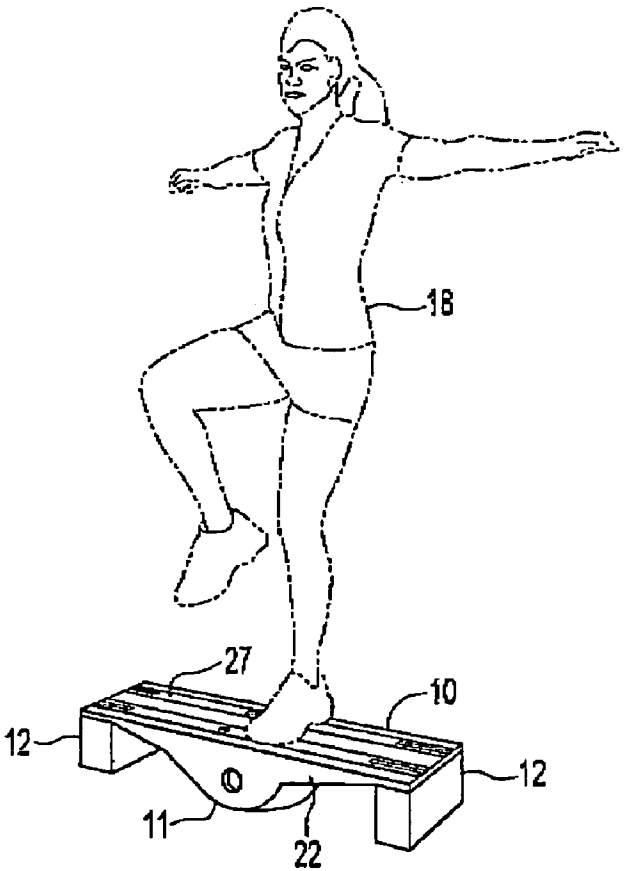
FIG. 2 is a perspective view of the bench platform with blocks and a user performing an exercise.
Figure 3:
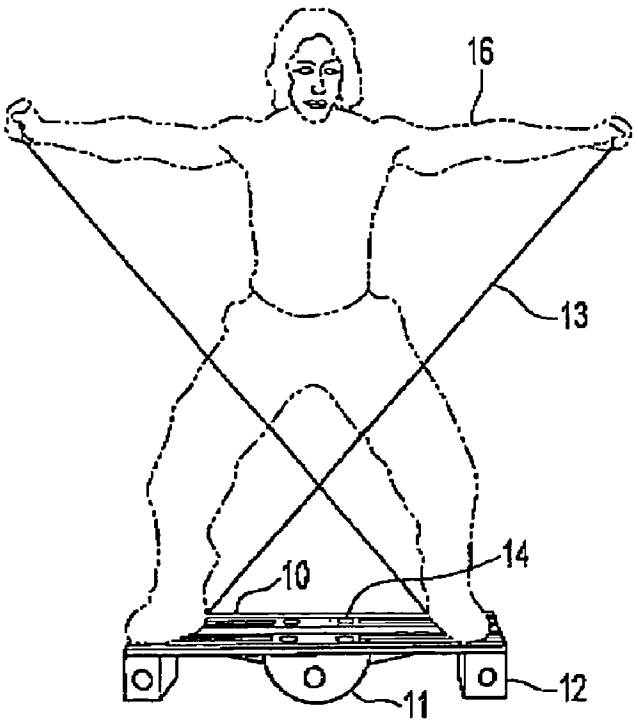
FIG. 3 is a perspective view of the bench platform and blocks, attached elastic cord or tubing or rope and a user.

Referring to FIG. 2, the bench platform 10 can be converted to a stepping platform by placing blocks 12 underneath each end of the deck 27. The bench platform 10 is then held in a stable horizontal position while a user 18 then uses it to perform the same exercises as she performs on a regular stepping platform. Alternatively, as seen in FIG. 3, elastic cord or tubing or rope 13 may be passed through selected ones of holes 14 to perform resistive exercises.

Figure 4:
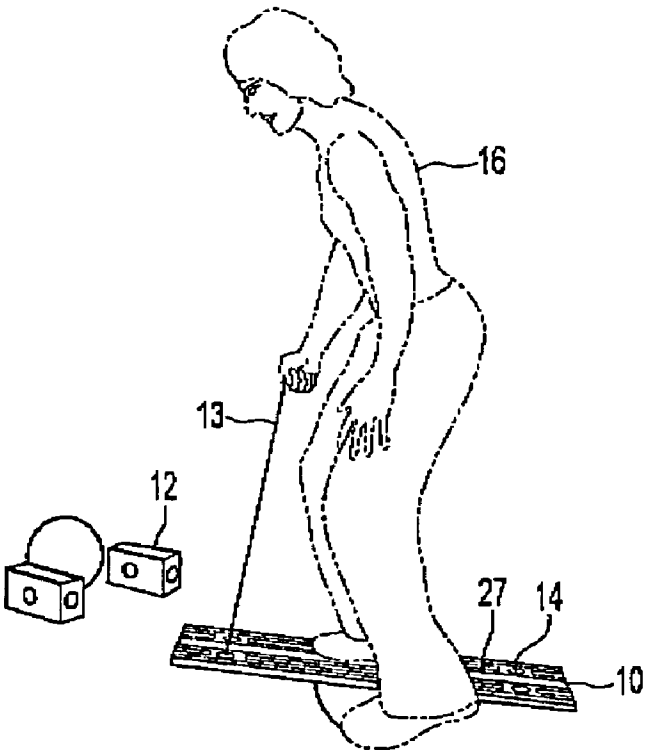
FIG. 4 is a perspective view of the bench platform with an attached elastic cord or tubing or rope and a user.

Referring to FIG. 4, with the bench platform 10 free to rock, an elastic cord or tubing or rope 13 is passed through holes in one end of the deck 27 and the elastic cord or tubing or rope 13 is pulled on while the user 16 balances on the bench platform 10 with one foot.

Figure 5:
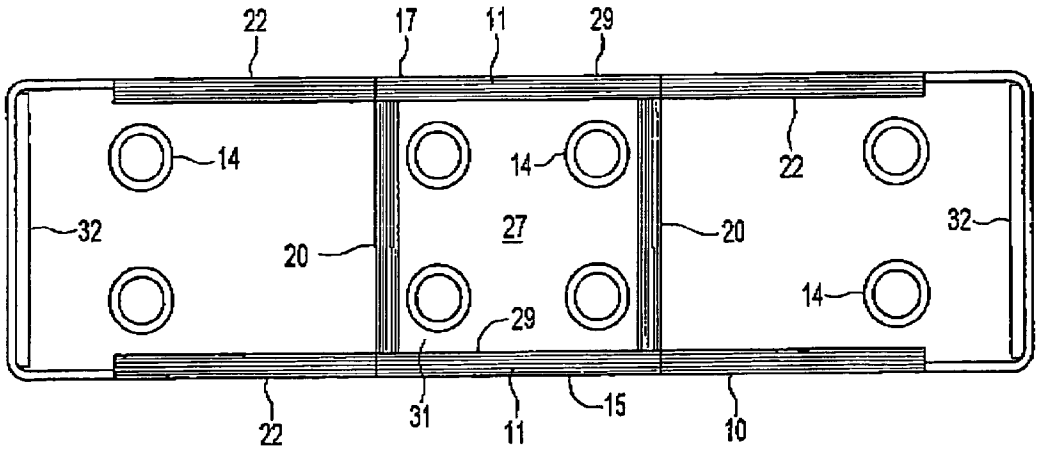
FIG. 5 is a bottom view of the bench platform.

As seen in FIG. 5, the bottom of the deck 27 discloses the rocker made up of two semicircular rocker plates 29 running parallel to adjacent edges of the deck 27 at the center of the latter. Cross supports 20 run from one rocker plate 29 to the other 29 at either end of the rocker plates 29 to define a central square recess 31. There are two holes 14 proximate either end of the deck 27 aligned parallel to the ends. There are four holes 14 in the recess 31 proximate each corner thereof. The ribs 22 run along the underside of deck 27 adjacent longitudinally extending edges thereof.

Figure 6:
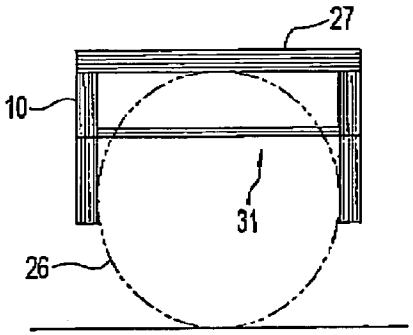
FIG. 6 is a side elevation view of the bench platform with a dotted outline of a ball.
Figure 10:
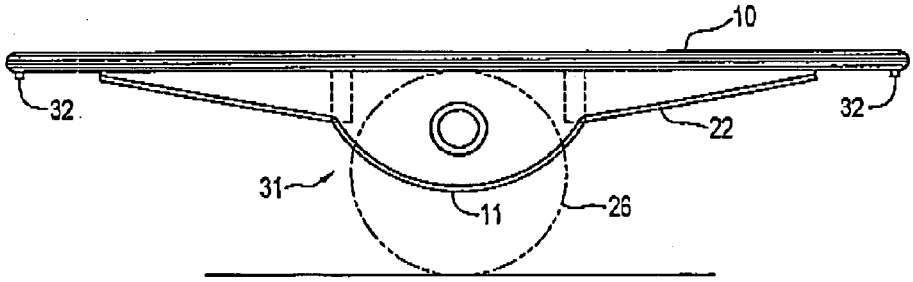
FIG. 10 is a front elevation view of the bench platform showing the dotted outline of a ball.

As seen in FIGS. 6 and 10, the recess 31 of the bench platform 10 is positionable over a 6 to 8 pound medicine ball or a size 5 soccer ball 26 having a diameter of 28 inches and shown in dotted outline. In this configuration the bench platform 10 functions as a wobble board.

Figure 7:
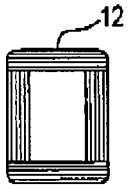
FIG. 7 is a cross sectional view of the block as viewed from an end.
Figure 8:
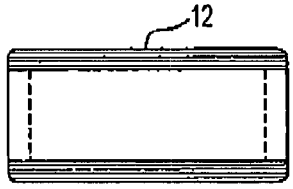
FIG. 8 is a cross-sectional view of the block as viewed from the side.

As shown in FIGS. 7 and 8, one of two blocks 12 is made up from 6sides and is hollow. These blocks are removably attached beneath the bench platform 10 on either end thereof and are used to convert the bench platform 10 to a stepping platform as discussed above.

Figure 9:
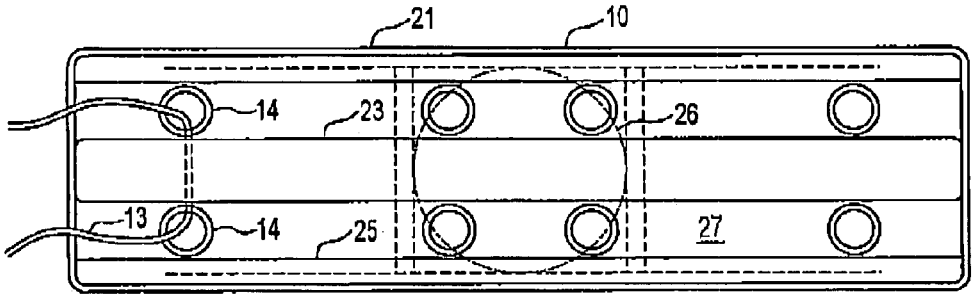
FIG. 9 is a top view of the bench platform.

The top of the bench platform 10 as shown in FIG. 9, has a plurality of holes 14 which can be used to pass through an elastic cord or tubing or rope 13. A user can pull up on the elastic cord or tubing or rope 13 in various ways to expand the range of exercises possible. Cord of different levels of resistance can be used. The top also has elongated strips 21, 23, and 25 of friction tape affixed to the deck. At the extreme ends the underside of the bench platform 10 has two rubber strips 32 extending across the bench platform 10 which soften the impact of the bench platform 10 with the floor and minimizes noise. Referring to FIG. 10 the profile of the rocker 11, and the ribs 22 can be seen in front elevation.

The length of the bench platform 10 is 38 inches so as to allow for proper lunges and squats. The width is 10.5 inches, which is the standard width of a staircase step. The height is 6 inches, which is the height of most platforms and stairs. The large surface area of the bench platform 10 provides a high level of stability and allows a wide variety of exercises from rehabilitation to all sports including extreme sports. The holes 14 are 1.5 inches in diameter to permit the free passage of resistance tubing handles and bungee cords or rope.

In operation the user 16 stands on the bench platform 10 and attempts to stay balanced while performing any number of exercises. The exercises can range from simply standing on the board with feet spread and attempting to maintain balance to pulling up on the elastic cord or tubing or rope 13 which can be looped through various sets of the holes 14 while standing, lunging or squatting. Alternatively, the bench platform 10 may be placed on top of a medicine or soccer ball and used as a wobble board, capable of multi-directional balancing and spinning through 360 degrees. Another option is to place the blocks 12 underneath either end of the bench platform 10 and use the bench platform 10 as a stepping platform. Finally, the blocks 12 may be used alone for yoga exercises. The strategically placed holes 14 allow many options for wrapping elastic cord or tubing or rope 13 to provide for both a positive and a negative resistance. This feature allows for strength conditioning of muscles in combination with balance and stability training. For example, extra balance and stability can be achieved by working with a partner or trainer who uses the elastics to exert a pull on the one training, strengthening his/her balance reaction.

Accordingly while this invention has been described with reference to illustrative embodiments, this description is not intended to be construed in a limiting sense. Various modifications of the illustrative embodiment will be apparent to those skilled in the art upon reference to this description. It is therefore contemplated that appended claims will cover any such modifications or embodiments that fall within the scope of the invention.

What is claimed is:

1. A bench platform assembly, comprising:

a. a deck having a bottom portion;

b. a rocker assembly affixed to said bottom portion of said deck, wherein said rocker assembly is aligned longitudinally with said deck; and, c. a pair of spaced apart ribs extending longitudinally out from said rocker assembly, one on each end thereof and adjacent longitudinally extending edges of said deck.

2. The bench platform of claim 1 wherein said rocker assembly comprises two spaced apart semi-circular rocker plates.

3. A bench platform, comprising:

a. a deck having a bottom portion;

b. a rocker comprising at least two spaced apart semi-circular rocker plates attached to said bottom portion of said deck, wherein said rocker is aligned longitudinally with said deck; and, c. at least two cross supports affixed to said bottom portion of said deck, wherein said rocker plates and said cross supports form a recess, wherein said recess receives a ball.

4. The bench platform of claim 3 further comprising a ball, wherein said ball is received by said recess.

5. The bench platform of claim 3 further comprising at least one elastic cord, tubing or rope, wherein said elastic cord, tubing, or rope passes through at least one hole in said deck.

6. The bench platform of claim 3 wherein said deck is substantially rectangular.

7. The bench platform of claims 3, further comprising blocks adapted to be placed under said deck, wherein said deck is converted to a horizontal stepping platform when said blocks are placed under said deck.

8. The bench platform of claim 7 wherein said blocks are removably attachable to said deck.

9. The bench platform of claim 3 further comprising elongate strips of friction tape attached to said deck.

10. The bench platform of claim 3, further comprising strips attached to the ends of said bottom portion of said deck wherein said strips soften the impact of said bench platform on a floor.

11. A bench platform, comprising:

a. a deck having a bottom portion;

b. a rocker comprising at least two spaced apart semi-circular rocker plates attached to said bottom portion of said deck, wherein said rocker is aligned longitudinally with said deck; and, c. blocks adapted to be placed under said deck, wherein said deck is converted to a horizontal stepping platform when said blocks are placed under said deck.

12. The bench platform of claim 11 wherein said blocks are removably attachable to said deck.

13. The bench platform of claim 11 further comprising at least one elastic cord, tubing or rope, wherein said elastic cord, tubing, or rope passes through at least one hole in said deck.

14. The bench platform of claim 11 further comprising elongate strips of friction tape attached to said deck.

15. The bench platform of claim 11 further comprising strips attached to the ends of said bottom portion of said deck, wherein said strips soften the impact of said bench platform on a floor.

* * * * *